United States Patent [19]

Kaufman

[11] Patent Number: 4,903,365

[45] Date of Patent: Feb. 27, 1990

[54] RESILIENT SCRUB BRUSH

[76] Inventor: Jack W. Kaufman, 357 Frankel Blvd., Merrick, N.Y. 11566

[21] Appl. No.: 250,080

[22] Filed: Sep. 28, 1988

[51] Int. Cl.[4] ..... A47L 13/12; A47L 13/26; A46B 11/00

[52] U.S. Cl. ..... 15/110; 15/114; 15/187; 401/28; 401/291

[58] Field of Search ..... 15/110, 106, 107, 104.93, 15/104.94, 114, 115, 116.2, 160, 167.3, 244.1, 119 R, 119 A, 187, 188, 105; 401/11, 9, 24, 25, 27, 139, 146, 207, 19, 261, 266, 267, 268, 272, 283, 291, 28; D32/42, 45, 44, 52, 50, 40; D4/116, 130, 137, 114; 132/75.3, 76.2; 118/270, 264; 220/339

[56] References Cited

U.S. PATENT DOCUMENTS

| | | | |
|---|---|---|---|
| D. 236,564 | 9/1975 | Kaufman | 15/114 X |
| D, 242,668 | 12/1976 | Kaufman | 15/114 X |
| 2,752,623 | 7/1956 | Tupper | 15/111 |
| 3,286,294 | 11/1966 | Raffe | 15/104.94 |
| 3,447,181 | 6/1969 | Coker et al. | 15/244.1 X |
| 3,556,667 | 1/1971 | Kaufman | 401/28 |
| 3,704,072 | 11/1972 | Kaufman | 401/28 X |
| 4,186,446 | 1/1980 | Kaufman | 15/114 X |
| 4,430,013 | 2/1984 | Kaufman | 401/133 X |
| 4,479,277 | 10/1984 | Gilman et al. | 15/106 X |
| 4,480,351 | 11/1984 | Koffler | 15/106 X |

FOREIGN PATENT DOCUMENTS

| | | | |
|---|---|---|---|
| 1115689 | 4/1956 | France | 15/119 A |

*Primary Examiner*—Harvey C. Hornsby
*Assistant Examiner*—Scott J. Haugland
*Attorney, Agent, or Firm*—Lackenbach Siegel Marzullo & Aronson

[57] ABSTRACT

An article such as a flat scrub brush has a major axis and a minor axis with a concave recess along the minor axis and at each end thereof, which enables the brush to be bent around this axis when used, and to be resiliently returned to its flat shape when not being used.

9 Claims, 1 Drawing Sheet

RESILIENT SCRUB BRUSH

BACKGROUND OF THE INVENTION

1. Field of the Invention

The present invention relates to an article such as a scrub brush having a major axis and a minor axis with a concave recess along one of these axes.

2. The Prior Art

The Kaufman U.S. Pat. No. 4,181,446 relates to a brush with a back having bristles on one face and being bendable to swing the bristles into oppositely extending relation for brushing engagement with an internal or concave surface. There is also a rubbing sponge secured to the other face of the back of the brush.

The Kaufman U.S. Pat. No. 4,430,013 relates to a package, such as a swab package, embodying a foam applicator pad and a pair of members comprising a backing member of a relatively rigid, flat sheet material adjacent the applicator pad, and a formed material for containing the flowable product in a reservoir formed in said material and captured between said two members. The flat sheet material is provided with a slit or weakened portion in the surface of said material, and the slit or weakened portion is transversely disposed so that upon rupturing it by forcing the opposite ends of the applicator package toward each other about the slit or weakened portion, thereby enabling the contents of the reservoir to be released into the foam pad upon pressure deforming the formed material.

The difficulty with the brush and swab constructions described in these prior art devices is that eventually they may tend to lack the resiliency necessary for repeated use, or for use more than one time. Due to the arrangement of the features of these prior art devices, once the brush or swab is bent or folded upon itself, an inelastic, and possibly an irreversible, deformation may occur which prevents any reusability for the cleaning device.

In the cleaning device shown in FIG. 1 of U.S. Pat. No. 4,181,446 or the device shown in FIG. 18 or FIG. 19 of U.S. Pat. No. 4,430,013, there is the added difficulty that there must be a weakened area or zone in the walls of the device to permit the bending or folding of the device. Once this weakened area is folded, permanent deformation is likely to occur.

In addition, once the user begins to bend the device, the side walls, or the end walls, depending upon the direction of bending, start to cause this deformation to force portions of the weakened zone to interact with one another. As the bending movement increases, these interacting portions then interfere with each other in this weakened zone, so as to either prevent further folding, or to necessitate the application of a significantly greater force than that which would be required if the portions of the weakened zone did not jam into each other.

SUMMARY OF THE INVENTION

It is an object of the invention to provide a disposable brush that is reuseable several times at the option of the user.

It is another object of the invention to provide a brush that is foldably deformable, yet resiliently reuseable.

It is a further object of the present invention to provide a scrub brush having a major axis capable of being bounded by end walls and a minor axis bounded by side walls with there being a concave recess either in each end walls or in each side wall, preferably at the end of the minor axes.

The present invention is directed to a disposable brush that is reuseable several times at the option of the user.

The present invention provides a brush that is foldably deformable yet resiliently reuseable.

The present invention relates to a scrub brush having a major axis capable of being bounded by end walls and a minor axis bounded by side walls, with there being a concave integrally formed continuous recess either in each end wall or in each of said side walls, preferably at the end of the minor axis.

The present invention further relates to a brush construction comprising a generally planar brush back having opposite faces, a multitude of integral bristles projecting from one face of said brush back, said brush back being self-sustaining in its normally flat condition and being fabricated of a plastic material having flexibility enabling said brush back to be bent or folded upon itself, and said brush being provided with a major axis and a minor axis, said brush having rib means defining upstanding side walls parallel to said major axis for stiffening the brush back against bending, said rib means being absent along end walls to facilitate the bending of said brush back along said minor axis to fold upon itself toward the other face of said brush back to swing said bristles into angular relation with each other for brushing engagement with an internal surface; and a concave recess in each of said side walls which serves to enhance the restoring power of said brush back to its unflexed normally flat condition.

The present invention will now be described by reference to the drawings which are not to be deemed limitative of the present invention in any manner thereof.

DESCRIPTION OF THE PREFERRED EMBODIMENT

Figure 1:
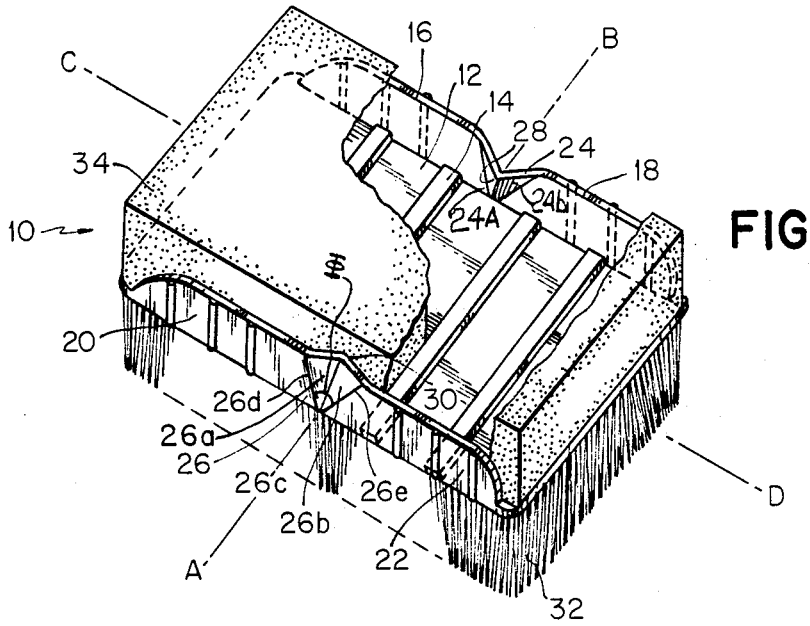
FIG. 1 is a top perspective view showing a brush construction of the present invention, partly broken away to illustrate internal structure.

Referring now more particularly to the drawings, and specifically to FIG. 1 thereof, a brush such as a preoperative surgical scrub brush is shown therein and generally designated 10. The brush includes a generally flat plate or body 12 defining a brush back, which may be normally flat and of elongate, preferably rectangular outline configuration, but without limitation thereto. The normally flat brush back 12 may be formed with through openings or perforations, such as slots 14 extending generally laterally across the width of the brush back. The openings or slots 14 may serve to pass soap or detergent and/or a disinfectant between opposite sides of the brush back, as will be more fully apparent hereinafter. Slots 14 are parallel to each other and about equally spaced down the length of the brush.

Figure 2:
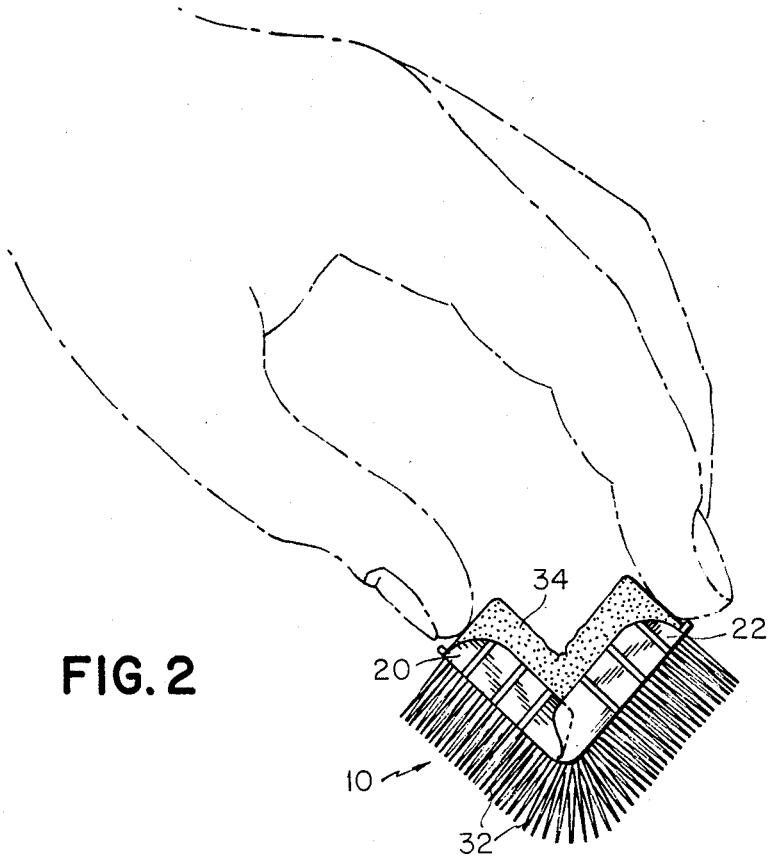
FIG. 2 is an end view of the instant brush construction in operative association with a user's hands.

In practice, the normally generally flat brush back 12 may be fabricated of a suitable plastic material, which may be self-sustaining in its normally flat condition, and having flexibility enabling the brush back to be bent or folded upon itself, for example, to an obtuse angle when desired, as shown in FIG. 2.

In the illustrated embodiment, the brush back 12 is of generally rectangular outline configuration, and provided on opposite side edges with upstanding longitudinal ribs or flanges 16, 18, 20, and 22. The longitudinal ribs or flanges 16, 18, 20, and 22 define upstanding side walls and effectively stiffen the brush back 12 against flexure or bending about a laterally extending or transverse minor axis A–B.

Extending in the longitudinal direction, and perpendicular to the minor axis is the major axis C–D. The longitudinal axis C–D runs parallel to longitudinal ribs 16–18 and 20–22 and bisects the distance between these longitudinal ribs.

Although not shown in FIG. 1, it is also possible to have extending along each end edge of brush back 12, an upstanding end wall, rib, or flange extending between and integral at its opposite ends with the adjacent ends of side flanges 16, 18, 20, and 22.

Located between longitudinal ribs 16 and 18 is concave recess 24, and approximately opposite thereto is located concave recess 26, which is located between ribs 20 and 22. Preferably recesses 24 and 26 are aligned along the transverse minor axis A–B, in such a manner that the center line of recesses 24 and 26 coincides with minor axis A–B.

The minor axis A–B bisects the brush 10 into two longitudinal halves, and is therefore the transverse or lateral centerline, while the major axis C–D bisects the brush 10 into two lateral halves and is therefore the longitudinal centerline.

Recess 26 (or 24) could be formed between flange 20 and 22 by starting with a continuous sidewall 20–22 and by the pressure crimping, using for example a heated pressing tool, of the zone 26 to produce an integrally formed continuous recess. Sidewall 20–22 or sidewall 16–18 remains continuous and unbroken and unnotched after the recess has been formed. Recess 26 is generally U-shaped or is preferably V-shaped as shown in FIG. 1, and has a first inclined surface **26*a* and a second inclined surface 26*b* forming a web portioning the side wall. Recess 24 is similarly U-shaped or is preferably V-shaped having a first inclined surface 24*a* and a second inclined surface 24*b* forming a web portion in the side wall. Inclined surfaces 26*a* and 26*b* may be slightly curved in shape or may be planar in shape; and usually surfaces 26*a* and 26*b* are polygonal or multisided in shape. Surfaces 26*a* and 26*b*** may be of the same or different shape.

Inclined surfaces **26*a* and 26*b* are preferably triangular in shape, and are usually isosceles triangles in shape which are fused together along a common side wall 26*c*. Common side wall 26*c* is one of the two equal sides within each of the isosceles triangles and common to both isosceles triangles. Side 26*d* is the same length as side 26*e* which is the same length as side 26*c*. The angle Φ between the planar surfaces 26*a* and 26*b*** may be an acute, right or obtuse, angle.

The same structure exists for recess 24, but for the sake of brevity a description thereof is not being repeated.

The criterion for determining the angle between surfaces **26*a* and 26*b* is based upon having this angle large enough, so that the bending of the plastic wall does not shred or tear this wall during the initial forming thereof. It is also based upon having the angle small enough, such that during use of the brush, it is possible to readily bend the brush, and to easily have the sidewalls 20 and 22 smoothly move past each other as the brush flat back 12 of FIG. 1 moves into the angular position shown in FIG. 2**. Hence, the angle Φ is greater than 0° but less than 180°. Thus, the angle Φ may range between 20° to 130°, desirably between 30° to 110° and preferably between 40° and 100°.

The advantages of having a U-shaped or preferably V-shaped recess as part of the invention, such as recess 24 or 26, versus a cut out notch 15 as shown in the prior art device in U.S. Pat. No. 4,181,446, are as follows. On the opposite sides of each of the prior art cut outs 15 are the adjacent flange portions 17. When it is decided to bend or fold the prior art brush along its axis, this is done by gripping the sides and swinging the brush portions back upwardly toward each other. In this condition for the prior art brush, the adjacent flange portions 17 on opposite sides of each cut out 15 may get jammed into each other, and may prevent any further swing motion for the flanges 17 back towards each other. This is because it has been found that the adjacent flange portions 17 on opposite sides of each cut out 15 do not always swing smoothly into an overlapping relationship with each other. Then after the user has finished using the bent or folded prior art brush, this brush may have been permanently bent and deformed into a folded shaped article. In other words, the amount of resiliency is inadequate to cause the used prior art brush to spring back into an acceptable flat shape for use again at a later time by the same, or by another, user.

The brush according to the present invention overcomes all of these disadvantages found in the prior art device due to the presence of the concave recess formed in the sidewalls of the brush according to the present invention.

The U-shape, or preferably V-shape, of the recess that points inwardly towards the longitudinal axis C–D, at V-28 for recess 24, or at V-30 for recess 26, readily permits the bending of the brush to occur very smoothly. This concave recess enhances the restoring power of the brush to move back to its unflexed normally flat condition and position after being bent. This is because, as the side wall sections 20 and 22, or 16 and 18, swing upwardly toward each other, the material of recess 26, or 24, can smoothly turn inwardly upon and against itself along the line **26*c* of the V as inclined surface 26*a* approaches inclined surface 26*b*. It is shown in FIG. 1 that these inclined surfaces can be shaped as isosceles triangles. Jamming up of the material causing interference with itself is prevented during bending within the concave recess, because the concave surface has already been preshaped into a recess that permits surfaces 26*a* and 26*b* to move smoothly towards each other. The same applies for surfaces 24*a* and 24*b***.

In addition, during the manufacture of the brush, the concave recesses 24 and 26 are created with a built-in resiliency, or memory, that enables the brush to be able to spring back and return to the flat back position shown in FIG. 1 after having been bent into the folded position shown in FIG. 2 by the user of the brush.

Unlike the prior art structure, wherein notches may be present in the end walls, here the side walls have no discontinuities, but are continuous and integrally formed side walls.

The ribs or flanges combine to define a generally upstanding wall about the upper or outer face of brush back or plate. Further, the brush back and the side wall or flange may advantageously be integrally fabricated of plastic, as by suitable mass production techniques, say injection molding, or the like. The particular plastic material must not only be easily moldable but must also have a "memory" whereby it will return to its original flat shape as molded. Suitable examples of such plastic materials include polyolefins, such as polyethylene, polypropylene, or polybutylene and the mixtures thereof. Also suitable are polyesters, such as polyesters of acrylic acid or methacrylic acid. Also polyvinyl compounds can be used, such as polyvinyl chloride.

It will be appreciated that the flange or wall effectively stiffens or rigidifies the brush back against flexure, except along a transverse medially extending region A–B of the brush back between the recesses. Thus, the transverse extending medial region of brush back, between the recesses is bendable or foldable to swing the remaining portions of the brush back upwardly toward each other. In this condition, the adjacent flange portions 16, 18, 20, and 22 on opposite sides of each recess are able to swing into overlapping relation, as may be seen in FIG. 2.

In addition, on the underside of brush back projecting downwardly and outwardly therefrom, generally normal thereto, are a multiplicity of projections or bristles 32. In practice, the bristles may be molded integral with and project in several parallel rows from the undersurface of brush back, generally in the direction away from the upstanding flange. While the bristles 32 are flexible, they generally move with the adjacent or contiguous portion of brush back, remaining generally normal thereto, so that certain bristles swing in angular relation with respect to other bristles. That is, the bristles 32 depending from the brush back on one side of the medial transverse brush back region swing in angular relation away from the bristles depending from the brush back region on the other side of the medial location. This condition is shown in FIG. 2, where it will be apparent that the brush back has been folded to a considerable degree upon itself, so as to occupy less overall space for convenient entry into a relatively small concavity or internal space, as between adjacent fingers of the user. It is by this highly efficient flexural action that the instant brush construction 10 is capable of effective brushing action in relatively small internal spaces or concavities, which were heretofore not accessible to conventional brush structures. However, it is understood that the instant brush construction sacrifices none of its brushing effectiveness on generally flat or convex surfaces, being usable thereon in its unflexed condition.

As described hereinbefore, the brush back 12, the flange, and the bristles 32 may all be integrally molded, for example, of plastic, as a single unit for efficient and economical production. In addition, there may be provided or secured a rubbing pad or sponge 34 seated on the upper side or surface of brush back 12 conformably within the flange. In the illustrated embodiment the rubbing pad or sponge 34 is of generally rectilinear configuration and snugly engaged within the side wall to be effectively retained thereby. If desired, the sponge or pad 34 may be impregnated with, or otherwise carry, a supply of soap or detergent, germicide or antiseptic for dispersion therefrom to the surface being scrubbed, as directly from the sponge and through openings 14 to the bristles 32. The sponge or rubbing pad is of a flexibility consistent with the desired manual flexibility of brush back, so that simultaneous flexure of both the brush back and sponge may be readily manually accomplished, as shown in FIG. 2.

Because bending of the sponge may cause a permanent deformation thereof, the restoring force stored in the memory of recess 26 is generally great enough so that the brush back returns with suitable rapidity to its generally flat planar condition.

From the foregoing, it is seen that the instant scrub brush is unique in structure, durable and reliable in operation, and greatly facilitates entry into and scrubbing action within relatively small spaces or internal surface regions, such as between the fingers, for increased overall scrubbing effectiveness.

It should also be appreciated that the exterior surfaces of the ribs or flanges may be suitably grooved (not shown) so as to facilitate gripping action by one's fingers.

Although the present invention has been described by reference to the preferred embodiments discussed above, it is to be understood that the invention is not to be so limited, to these preferred embodiments, but instead is only to be defined by the scope of the following appended claims.

What is claimed is:

1. An article, comprising flexible scrub brush having a flat shape when not in use and having a major axis, end walls, side walls, and a minor axis intersecting the side walls of the article, a concave, integrally formed recess in each said ride wall intersection of said minor axis and the corresponding side wall, so that the brush, when used, bends around the minor axis to form two longitudinal halves to be resiliently returned to its flat shape when not being used, said side walls each comprising main side wall portions and a web portion connecting the main side wall portions, wherein each said recess is defined by one said web portion and each web portion comprises a first inclined surface and a second inclined surface inclined with respect to the main side wall portions and to each other, with each said inclined surface being polygonal and planar in shape.

2. The brush construction of claim 1, wherein each of said concave integrally formed recesses is located at about the mid-point of its refractive side wall corresponding to one of the ends of the minor axis of said brush.

3. The article of claim 1, wherein each of said inclined surfaces is triangular in shape.

4. The article of claim 3, wherein each of said inclined surfaces is isosceles triangular in shape said isosceles triangles are fused together along a common side wall, which common wall is one of the two equal sides of the isosceles triangles.

5. The article of claim 4, wherein an angle between the two planar inclined surfaces varies within the range of 0° to 180° during operation of the article.

6. The article of claim 5, wherein the angle between the two planar inclined surfaces is from 20° to 130°.

7. The article of claim 6, wherein the angle between the two planar inclined surfaces is from 30° to 110°.

8. The article of claim 7, wherein the angle between the two planar inclined surfaces is from 40° to 100°.

9. The article of claim 1 further comprising a generally planar brush back having opposite faces, a multitude of integral bristles projecting from one face of said brush back, said brush back being self-sustaining in its normally flat condition and being fabricated of a plastic material having flexibility enabling said brush back to be bent or folded, said side walls further comprising rib means defining substantially upstanding walls being substantially parallel to said major axis for stiffening the brush back against bending, a resilient rubbing sponge secured on said brush back and engageable within the upstanding walls.

* * * * *